US005607135A

United States Patent [19]

Yamada

[11] Patent Number: 5,607,135

[45] Date of Patent: Mar. 4, 1997

[54] TABLET STAND

[76] Inventor: Hiroshi Yamada, 2-1-9, Kowakae, Higashi-Osaka, Japan

[21] Appl. No.: 391,893

[22] Filed: Feb. 21, 1995

[30] Foreign Application Priority Data

Dec. 2, 1994 [JP] Japan ..... 6-016061 U

[51] Int. Cl.[6] ..... A47G 1/24

[52] U.S. Cl. ..... 248/456; 248/447; 248/454; 248/455; 248/461; 248/463; 248/465

[58] Field of Search ..... 248/447, 454, 248/455, 456, 461, 463, 465

[56] References Cited

U.S. PATENT DOCUMENTS

| | | | |
|---|---|---|---|
| 2,017,518 | 10/1935 | Wagner | 248/456 |
| 2,173,379 | 9/1939 | Smith | 248/456 |
| 2,374,409 | 4/1945 | Brennan | 248/456 X |
| 2,583,097 | 1/1952 | Heimann | 248/456 |
| 3,411,741 | 11/1968 | Nadler | 248/456 |
| 3,447,770 | 6/1969 | Gallamos | 248/456 X |
| 3,991,967 | 11/1976 | Sack | 248/456 X |
| 4,323,214 | 4/1982 | DeLuca | 248/456 X |
| 4,460,146 | 7/1984 | Raggiotti | 248/456 |

*Primary Examiner*—Leslie A. Braun
*Assistant Examiner*—Richard M. Smith
*Attorney, Agent, or Firm*—Moonray Kojima

[57] ABSTRACT

A foldable one-piece tablet stand comprising a base section, a back rest section which can be raised and lowered into the base section, a pair of protrusions which can be raised and lowered into the base and disposed at a front part of the base section so that when both the back rest section and protrusions are in the raised conditions, a tablet will be held by the back rest section with a bottom of the tablet held by the base section and secured by the pair of protrusions, and a holder section which is foldable into the base section and hinged on the back of the back rest section and held on parts of the base section so that the back rest section will be fixed thereby, whereby an inexpensive one piece plastic construction is possible to form the tablet stand with efficiency and economy.

4 Claims, 9 Drawing Sheets

TABLET STAND

SUMMARY OF THE INVENTION

This invention relates to a tablet stand for putting up a tablet on a base of installation such as desk, etc. characterized in that all its components are designed to be molded in a single piece with synthetic resin, enabling low-cost production and easy handling. This tablet stand fastens the lower end of the tablet with the fastening section which gets in standing state by upward folding formed at the front end of the grounding section to be in contact with the base of installation and supports the back face of the tablet with a raisable back rest formed on the same plane as the said grounding section. Single-piece molding makes it possible to realize low-cost production by reducing the number of parts and making assembling work unnecessary. Moreover, in spite of its simple shape, the said back rest can solidly support tablet of many different shapes in combination with the back rest of the said supporting section, if it is constituted with a back rest body and a supporting leg which supports that back rest body at prescribed leaning angle through a hinge section. Furthermore, when this tablet stand is out of use, it can be deformed into a compact sheet-like shape.

BACKGROUND OF THE INVENTION

There are many different kinds of tablet stands used for decorating various kinds of tablets such as photographs, pictures, works of calligraphy, plates, painted plates, plate clocks, etc. on a base of installation such as a desk, cabinet, etc. and they all are of a 3-dimensional shape having a fastening section for fastening the lower end of the tablet and a back rest for supporting the back face of the tablet. Such tablet stands of 3-dimensional shape are constituted by assembling a plural number of members.

For that reason, they present a problem of high cost because they require formation of a plural number of different kinds of members and assembling work for assembling those members. Moreover, because of a difference of orientation in space between the fastening section and the back rest section, it is difficult to deform them into any compact shape like sheets even when they are out of use.

OBJECTS OF THE INVENTION

The object of this invention is to provide a tablet stand produceable at lost cost by enabling reduction of the number of parts and omission of assembling work.

Another object of this invention is to provide a tablet stand fit for easy handling by simplifying the work required for its use.

Still another object of this invention is to provide a tablet stand capable of stable supporting in spite of a simple construction.

A further object of this invention is to provide a tablet stand which can be deformed into a sheet-like compact shape when it is out of use.

EXAMPLE

An example of this invention will be described in detail based on the drawings hereafter.

Figure 1:
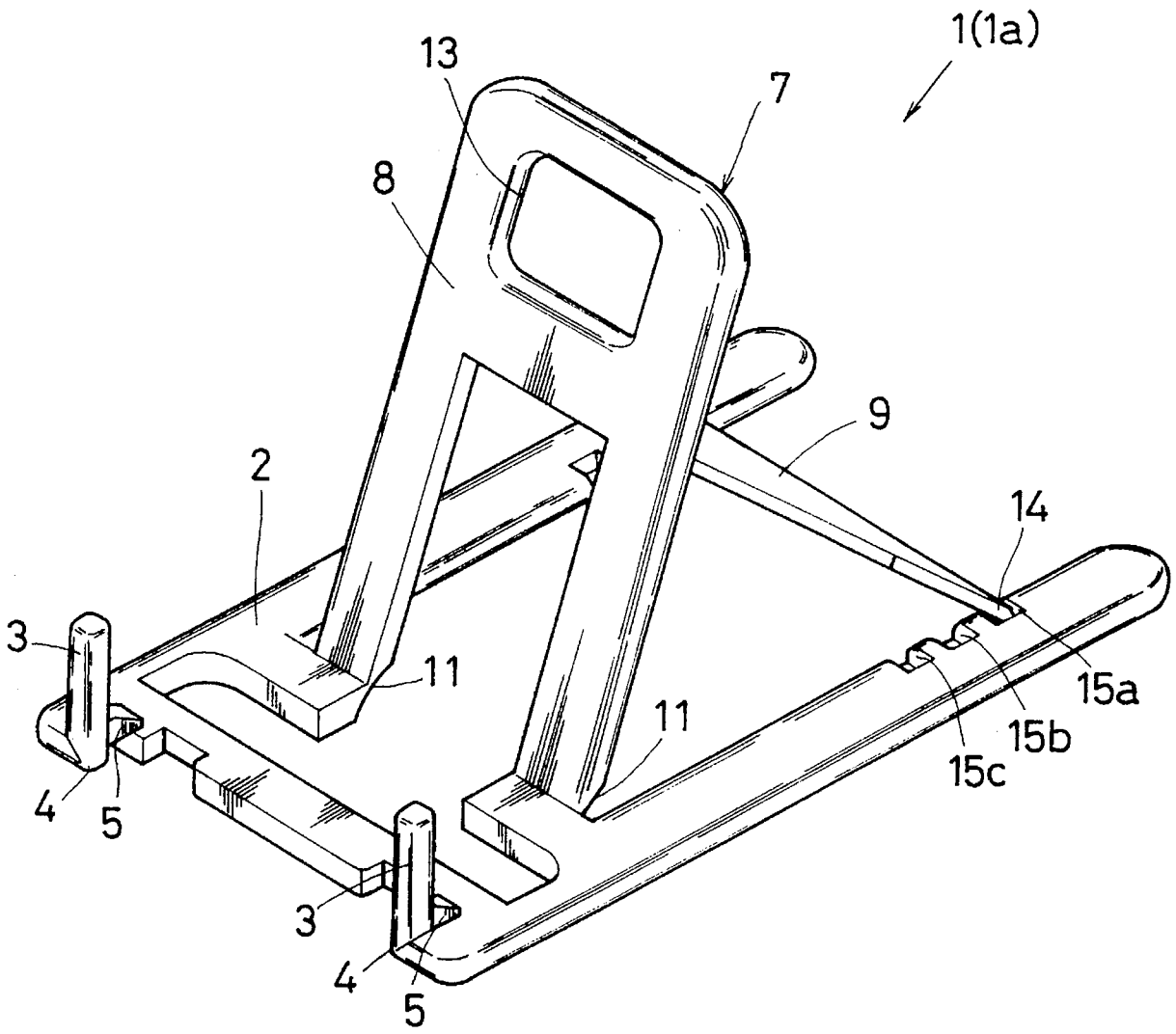
FIG. 1 is a perspective view of the tablet stand in the raised state.

FIG. 1 is a perspective view of the tablet stand 1 in the raised state. As shown in this drawing, the tablet stand 1 gets in the shape fit for use when the folding body 1*a* (see FIG. 2) formed in a single piece with synthetic resin is folded. As synthetic resin, a material capable of forming a flexible thin part for hinge section such as polypropylene, etc. will be ideal.

Figure 2:
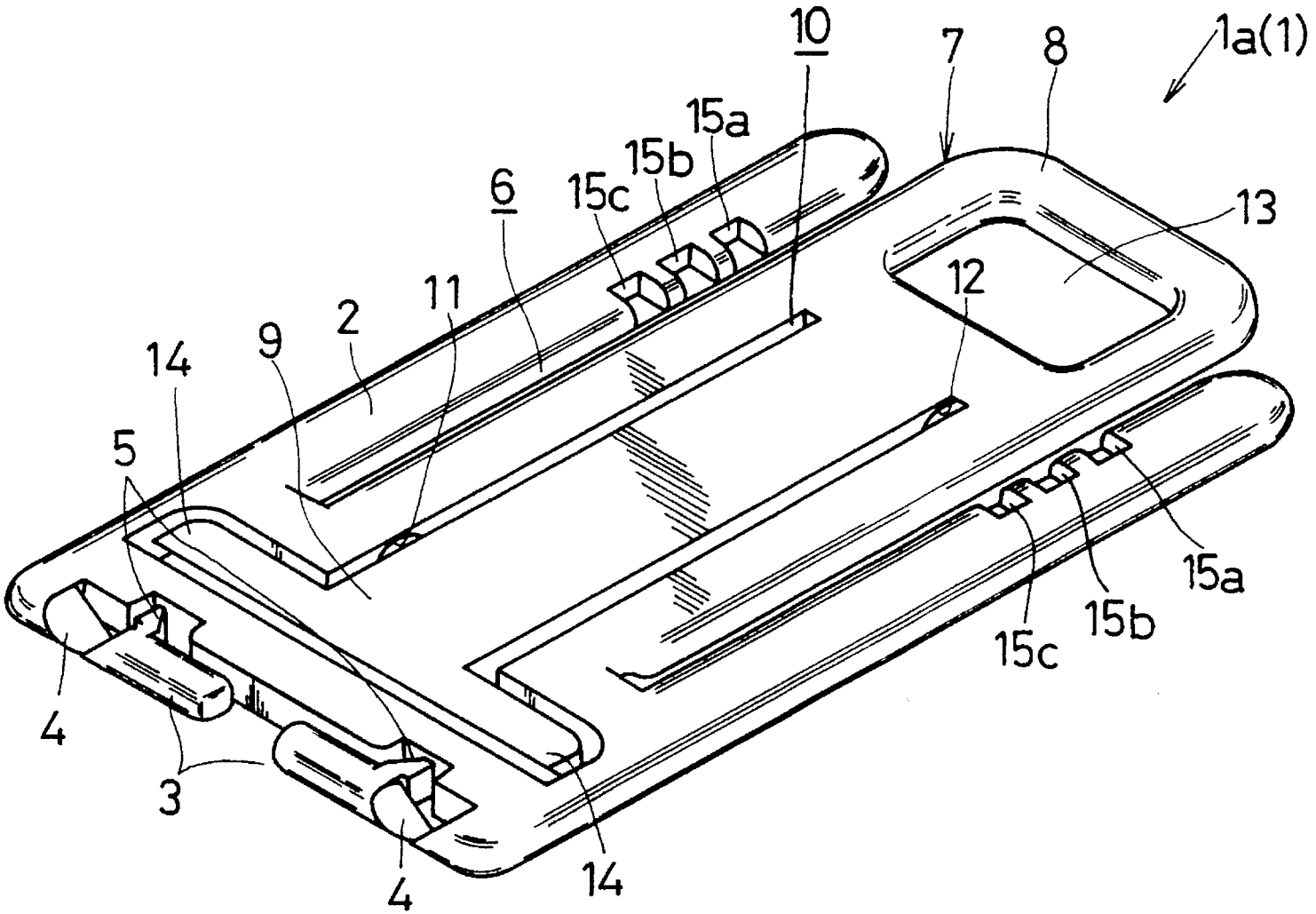
FIG. 2 is a perspective view of the tablet stand in the folded state.

The said folding body 1*a* is a sheet-like member of approximately square shape of a thickness about uniform as a whole as shown in FIG. 2 and forms a grounding section 2 of a proper width on both the left and the right sides as well as on the front side connecting those parts. This grounding section 2 is designed to be in contact with a base of installation such as the top face of a desk, the top face of a cabinet, etc., for example.

Moreover, at the front end of this grounding section 2, two fastening sections 3, 3 are formed through No. 1 hinge sections 4, 4. The direction of formation of the fastening sections 3, 3 is the direction of width of the folding body 1*a* (tablet stand 1) and those fastening sections 3, 3 can be put in standing position if they are folded to outside at the No. 1 hinge sections 4, 4. The projections formed on the inner side of the fastening sections 3, 3 are fastening claws 5, 5 constituting a fastening means. Those fastening claws 5, 5 maintain the standing state of the fastening sections 3, 3 by being engaged with the top face of the grounding section 2 when the fastening sections 3, 3 are put to the standing position.

In the portion held between the left and right sides of the said grounding section 2, a back rest 7 is formed through a separating groove 6. This back rest 7, which is intended to support the back face of the tablet, is composed of a rest body 8 to be directly in contact with the back face of the tablet and a supporting leg 9 which supports that rest body 8 at a prescribed angle and forms a separating groove 10 between the rest body 8 and supporting leg 9.

The rest body 8 is formed in about inverted U shape in plan view while the supporting leg 9 is formed in inverted T shape in plan view. The rest body 8 and supporting leg 9 are foldably connected to each other in the same way as the said fastening sections 3, 3 through No. 2 hinges 11, 11 and No. 3 hinge 12 on the back side. The said No. 1 hinges 4, 4, No. 2 hinges 11, 11 and No. 3 hinge 12 are all formed in thin parts.

The rest body 8 is connected to the grounding section 2 by forming the said No. 2 hinges 11, 11 at both ends. The supporting leg 9 is connected to the inside of the rest body 8 by forming the said No. 3 hinge 12 at its base.

A notch 13 is formed to make it easy to raise the rest body 8 and hold the folding body 1*a* (tablet stand 1) by hand as well as to improve the product design.

Figure 3:
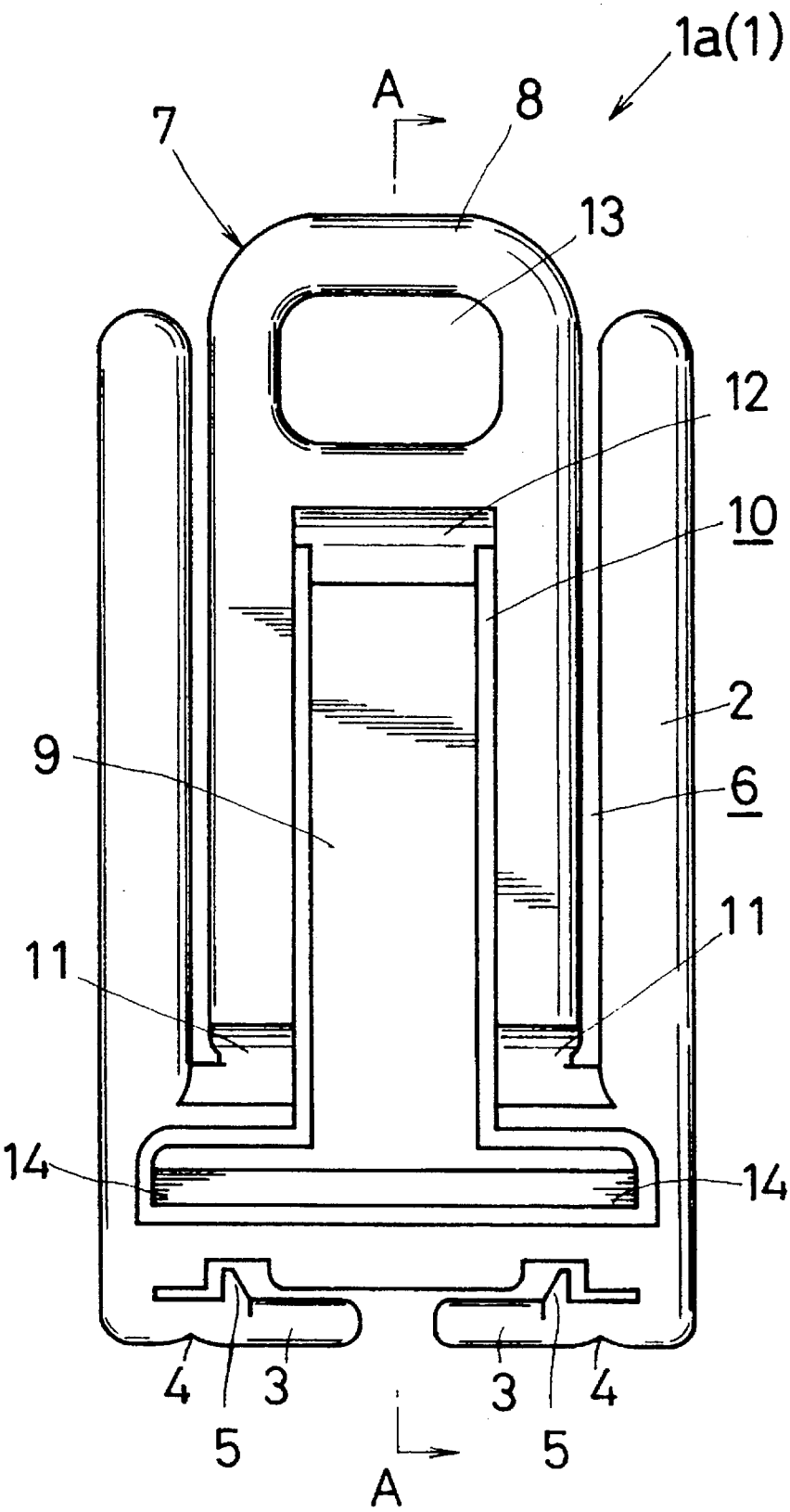
FIG. 3 is a bottom plan view of the tablet stand in the folded state.
Figure 4:
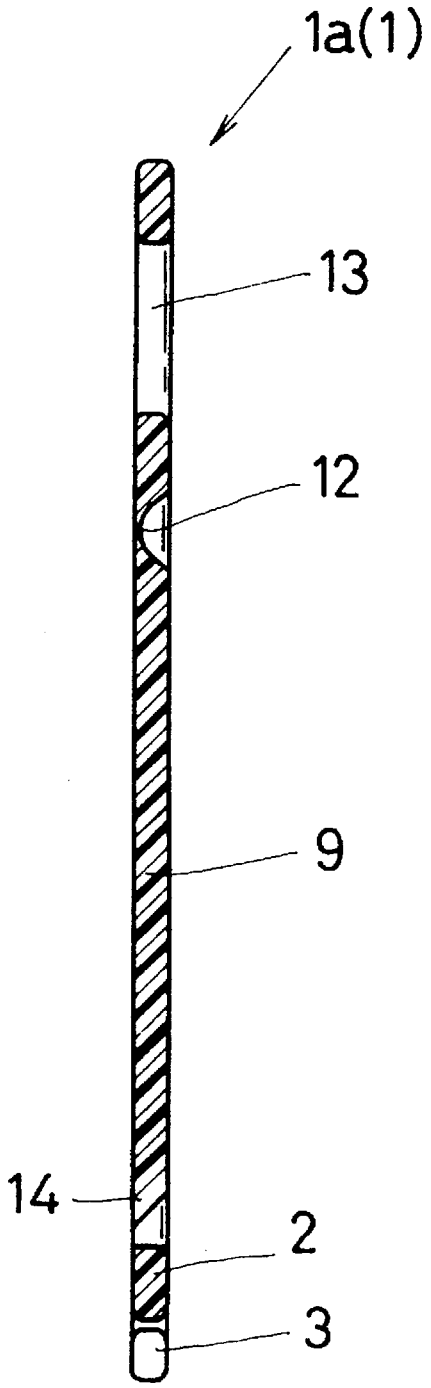
FIG. 4 is a sectional view of the view A—A in FIG. 3.

In addition, the free edge of the supporting leg 9 is formed at a length reaching the opposite inside of the grounding section 2 as indicated in FIG. 2 and FIG. 3 and forms pointed fastening claws 14, 14.

Figure 5:
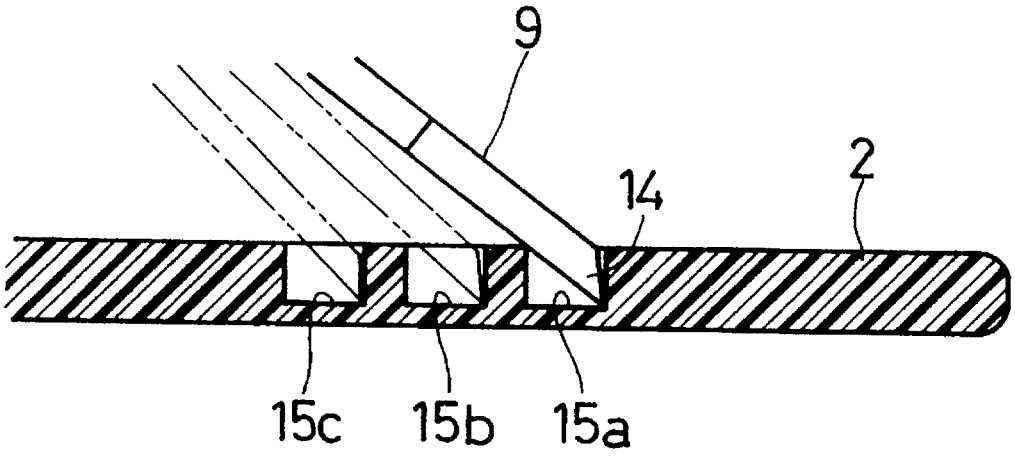
FIG. 5 is a sectional view in the state where the fastening claw of the supporting leg is engaged.

Those fastening claws 14, 14, which are intended to support the back rest 8 at a prescribed angle, are fastened to concave parts 15*a*, 15*a*, 15*b*, 15*b*, which are formed on the opposing inside of the grounding section 2 (see FIG. 5). In this example, 3 sets of fastening concave parts 15*a*, 15*a*, 15*b*, 15*b*, 15*c*, 15*c* are formed along the longitudinal direction of the grounding section 2 so that 3 steps of rest angle may be obtained.

The tablet stand 1 (1*a*) constructed in this way will be used as described hereafter. First, bend the two fastening sections 3, 3 at the No. 1 hinges 4, 4 and maintain that state with the fastening claws 5, 5. Next, raise the rest body 8 in about inverted U shape in plan view. As the supporting leg 9 in inverted T shape in plan view swings to the back side with this motion, fasten the fastening claw 14 at free edge to the desired fastening concave parts 15*a*, 15*a*, 15*b*, 15*b*, 15*c*, 15*c* of the grounding section 2. This will allow the rest body 8 to be retained at the desired rest angle of the 3 steps.

Figure 6:
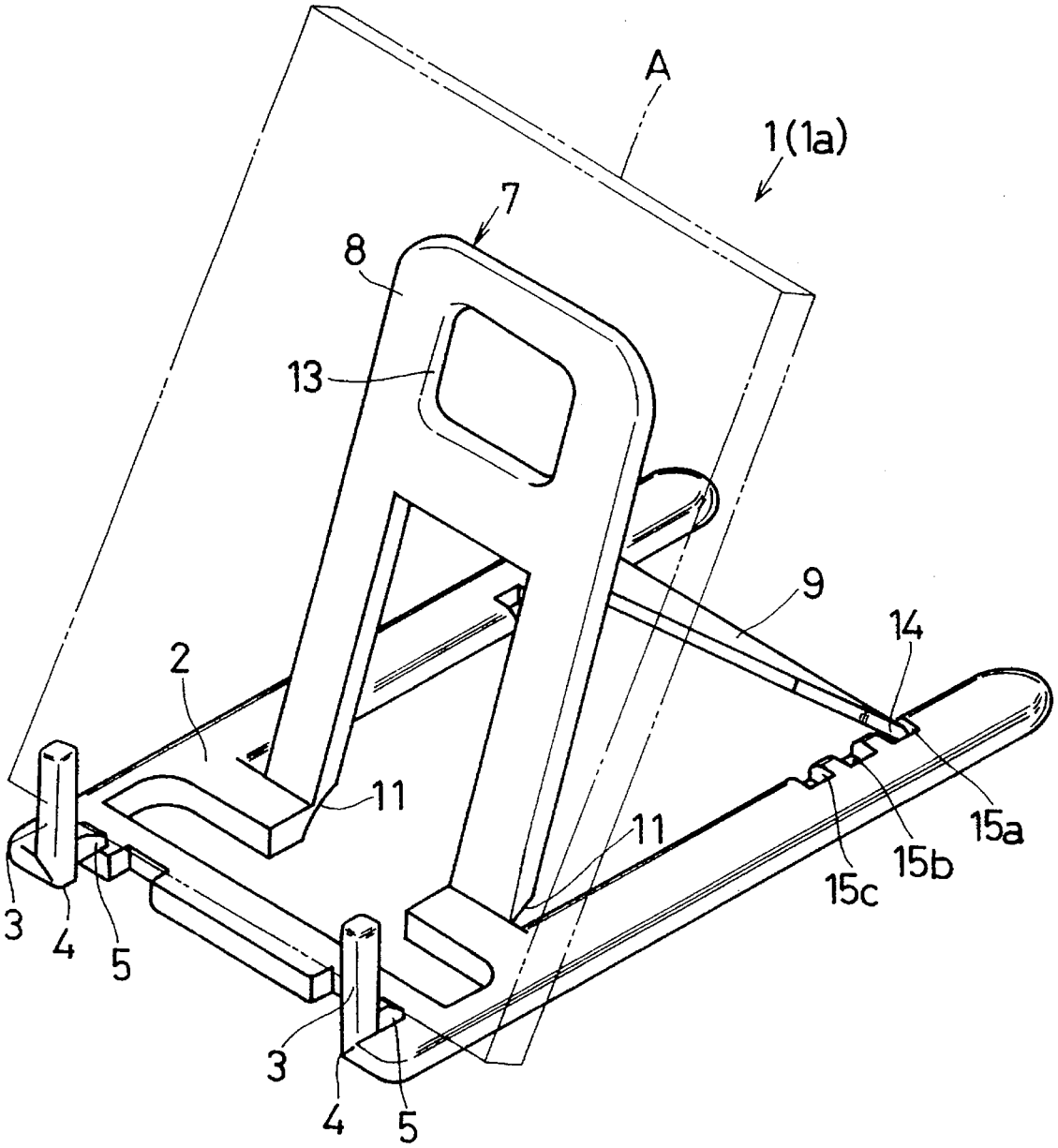
FIG. 6 is a reference drawing of the state of use.

In order to put up the tablet A, all you have to do is just fasten the lower end of the tablet A to the fastening sections 3, 3 and lean the back face of the tablet on the rest body 8 (see FIG. 6).

When the tablet stand is out of use or during its circulation as merchandise as a matter of course, remove the fastening claws 14, 14 of the supporting leg 9 from the fastening concave parts 15*a*, 15*a*, 15*b*, 15*b*, 15*c*, 15*c* and push in the rest body 8 and the supporting leg 9 on one same plane.

After that, extend the fastening sections 3, 3 and deform them into a sheet-like folding body 1*a*.

In this way, this tablet stand can realize cost reduction by reducing the number of parts and eliminating assembling work thanks to its single-piece molding of synthetic resin.

Moreover, it is easy to handle because all you have to do for its use is to raise the back rest 7. This tablet stand is also convenient for storing or carrying because it can be deformed into a sheet-like compact folding body 1*a* when it is out of use. In addition, in the said deformation in which the back rest 7 is raised, the supporting leg 9 swings to the back side and the fastening claws 14, 14 automatically move toward the fastening concave parts 15*a*, 15*a*, 15*b*, 15*b*, 15*c*, 15*c* when the rest body 8 is raised, thus facilitating the raising of the back rest 7.

Furthermore, in the state of use in raised position, stable supporting is possible regardless of the weight of the tablet A because the rest body 8 is supported by the supporting leg 9. This stability further improves with a large width which can be secured thanks to the fact that the grounding section 2 is formed on the outer side of the rest body 8.

This effect further increases with the upward projection of the fastening sections 3, 3, ensuring stable standing of the tablet A however large it may be.

Moreover, being located at 2 points or on the left and on the right side, the fastening sections 3, 3 can put up tablet A of various forms as desired without restriction of size or shape with a change of angle of the rest body 8.

Figure 7:
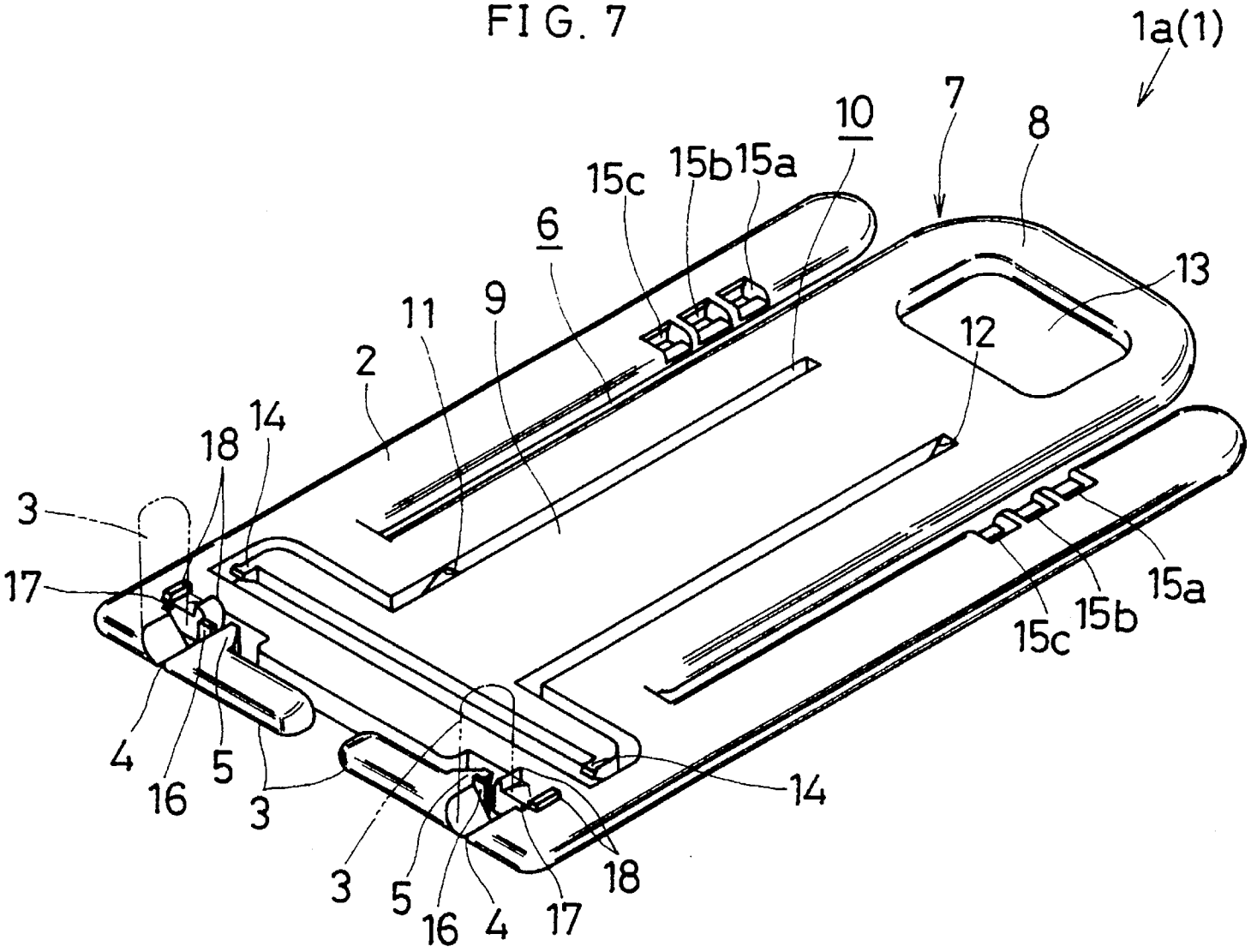
FIG. 7 is a perspective view in the folded state indicating another example of a tablet stand.
Figure 8:
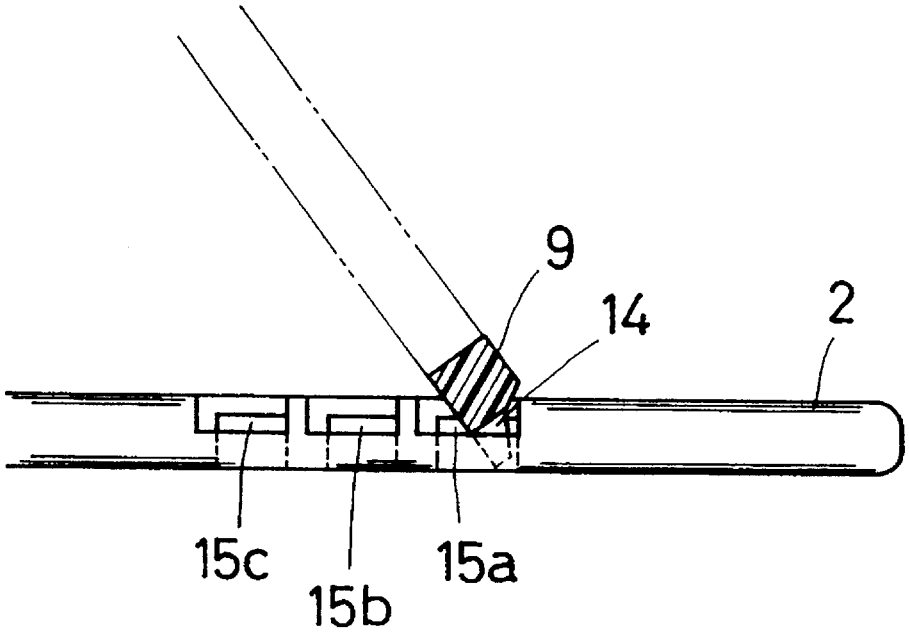
FIG. 8 is a sectional view in the state where the fastening claw of the supporting leg of the tablet stand in FIG. 7 is engaged.
Figure 9:
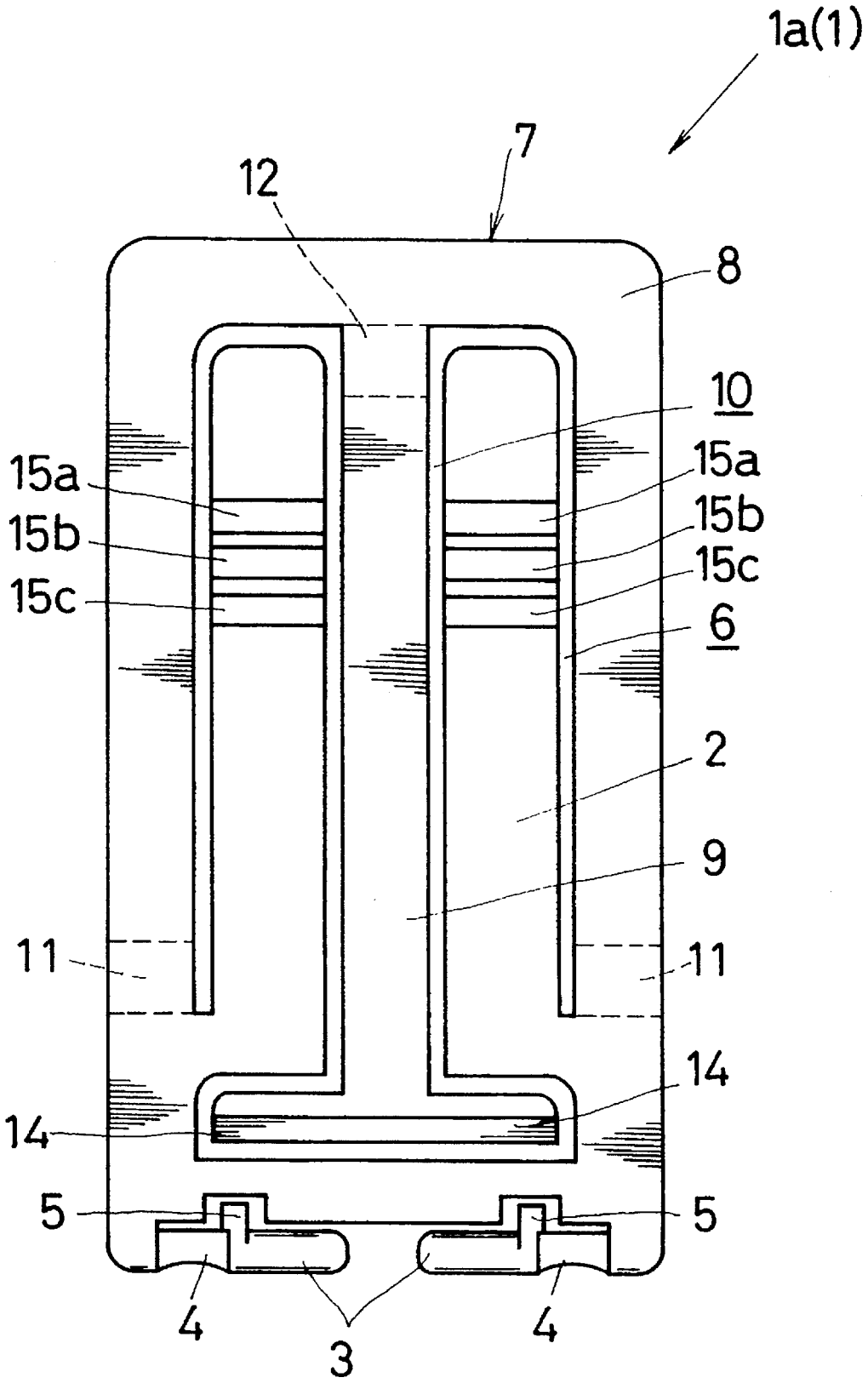
FIG. 9 is a plan view in the folded state indicating another example of a tablet stand.

FIG. 7, FIG. 8 and FIG. 9 indicate other examples.

In FIG. 7, the fastening claws for holding the fastening sections 3, 3 formed at the front end of the grounding section 2 in the standing state are composed of the fastening claws 5 indicated in the previous example and 3 fastening claws in the shape of projection or projected sheet formed in single piece, reinforcing the standing state.

One fastening claw 16, formed in the fastening sections 3, 3, gets in the gap 17 with the grounding section 2 when the fastening sections 3, 3 are put to the standing position and prevents the fastening sections 3, 3 from falling in the longitudinal direction. The other two fastening claws 18, 18, formed on the top face of the grounding section 2, pinch the fastening claw 5 to prevent the fastening sections 3, 3 from falling in the transversal direction when the fastening sections 3, 3 are raised.

Also in this FIG. 7, the fastening claws 14, 14 formed at both edges of the free end in the supporting leg 9 are formed in a way to protrude in the longitudinal direction of the supporting leg 9. The fastening concave parts 15*a*, 15*a*, 15*b*, 15*b*, 15*c*, 15*c*, where those fastening claws 14, 14 are to be fastened, are formed with the outer side pierced in the vertical direction while leaving the stepped part inside. The state in which the fastening claws 14, 14 are fastened to the fastening concave parts 15*a*, 15*a*, 15*b*, 15*b*, 15*c*, 15*c* is as shown in FIG. 8.

Moreover, FIG. 9 indicates a case of formation in which the position of the grounding section 2 and that of the rest body 8 in the previous example are changed with each other.

The No. 1 hinges 4, 4 of this example correspond to the thin part of the 5th claim, the No. 2 hinges 11, 11 correspond to the hinge of the first claim, the hinge of the 2nd claim and the hinge of the 3rd claim, and No. 3 hinge 12 correspond to the thin part of the 2nd claim and the thin part of the 3rd claim.

What is claimed is:

1. A foldable tablet stand comprising:

a grounding section comprising a substantially flat frame having an end portion and a pair of parallely disposed legs extending therefrom;

fastening means comprising post means and first claw means and attached by first hinge means to said end portion of said frame of said grounding section, whereby in a raised position, said post means of said fastening means is in a direction generally perpendicular to said flat frame of said grounding section and said first claw means holds said post means in said generally perpendicular direction by resting against said frame of said grounding section, and whereby in a rest position said post means of said fastening means is in a direction generally planar with said flat frame of said grounding section with said first claw means fitted in first grooves located in said end portion of said frame of said grounding section;

a substantially flat back rest means comprising an end portion and a pair of legs extending therefrom, said pair of legs being attached to said frame of said grounding section by second hinge means and being movable so that in a raised position, said back rest means is at an angle to said flat frame of said grounding section so as to hold a tablet with an end of the tablet resting against said end portion of said frame of said grounding section and held by said post means of said fastening means and having a surface of said tablet being held at said angle by said back rest means, and so that in a rest position, said back rest means is substantially planar with said flat frame of said grounding section; and supporting means comprising a flat portion attached movably to said back rest means and at least one leg extending therefrom and comprising second claw means, whereby said second claw means is held in second grooves located in said pair of legs of said frame of said grounding section to hold said back rest means at said angle in said raised position, said flat portion of said supporting means being movably held by third hinge means to said end portion of said back rest means so that in a rest position said second claw means are moved out of said second grooves and positioned to be within the same plane as said grounding section; whereby said tablet stand is made of a unitary structure of molded resin so that in the rest position, a substantially flat structure is provided, and in a raised position, a tablet stand is provided by said fastening means, said end portion of said frame of said grounding section, and said back rest means with said supporting means holding said back rest means at said angle.

2. The device of claim 1, wherein said first, second and thin hinge means are formed of thin parts so that all of the components of said tablet stand are of the same unitary structure.

3. The device of claim 1, wherein said first claw means and said second claw means are configured to fit within the plane of said grounding section in the rest position.

4. The device of claim 3, wherein said supporting means is fit within the plane of the grounding structure in the rest position.

* * * * *